US009915060B2

(12) United States Patent
Hall et al.

(10) Patent No.: US 9,915,060 B2
(45) Date of Patent: Mar. 13, 2018

(54) RINSING TOILET SEAT

(71) Applicants: David R. Hall, Provo, UT (US); Dan Allen, Springville, UT (US); Jared Reynolds, Pleasant Grove, UT (US); Joshua Larsen, Spanish Fork, UT (US); Eric Magleby, Provo, UT (US)

(72) Inventors: David R. Hall, Provo, UT (US); Dan Allen, Springville, UT (US); Jared Reynolds, Pleasant Grove, UT (US); Joshua Larsen, Spanish Fork, UT (US); Eric Magleby, Provo, UT (US)

( * ) Notice: Subject to any disclaimer, the term of this patent is extended or adjusted under 35 U.S.C. 154(b) by 1 day.

(21) Appl. No.: 15/193,662

(22) Filed: Jun. 27, 2016

(65) Prior Publication Data

US 2017/0370082 A1 Dec. 28, 2017

(51) Int. Cl.

| | |
|---|---|
| ***A47K 13/30*** | (2006.01) |
| ***E03D 5/00*** | (2006.01) |
| ***E03D 9/00*** | (2006.01) |
| ***A47K 13/12*** | (2006.01) |

(52) U.S. Cl.

CPC ..... *E03D 9/002* (2013.01); *A47K 13/12* (2013.01); *A47K 13/30* (2013.01); *E03D 5/00* (2013.01)

(58) Field of Classification Search

CPC ..... A47K 13/302; A47K 13/10; E03D 1/24; E03D 1/28

USPC ..... 4/425

See application file for complete search history.

(56) References Cited

U.S. PATENT DOCUMENTS

| | | | | |
|---|---|---|---|---|
| 4,561,131 | A * | 12/1985 | David | E03D 1/145 4/324 |
| 5,123,124 | A * | 6/1992 | Brower | A47K 13/10 4/217 |
| 6,279,174 | B1 * | 8/2001 | Candusso | E03D 9/002 4/224 |
| 6,622,315 | B1 * | 9/2003 | Feygin | A47K 13/30 4/223 |
| 2009/0276948 | A1 * | 11/2009 | Meshreky | A47K 13/24 4/444 |
| 2011/0113540 | A1 * | 5/2011 | Plate | E03D 1/01 4/300 |
| 2012/0174310 | A1 * | 7/2012 | Grover | E03D 11/08 4/425 |
| 2015/0059076 | A1 * | 3/2015 | Tiagai | E03D 9/08 4/447 |

* cited by examiner

*Primary Examiner* — Janie Loeppke

(57) ABSTRACT

An rinsing seat for a rimless toilet is disclosed. In one embodiment, the rinsing seat includes a large annular cavity for the purpose of storing and dispensing rinse water. In another embodiment, the rinsing seat includes a smaller annular cavity for the purpose of dispensing rinse water from a pressurized line. Outlet nozzles arranged about the circumference of the rinsing seat and designed to dispense rinse water at varying angles relative to the rinsing seat are disclosed. Rinsing seat supports, hinge assemblies, and seat sensors which offer additional functionality to the rinsing seat are also disclosed and claimed herein.

19 Claims, 11 Drawing Sheets

RINSING TOILET SEAT

BACKGROUND

Field of the Invention

This invention relates to toilet seats, and in particular to toilet seats capable of rinsing a toilet.

Background of the Invention

Conventional toilets have a rim around the perimeter of the toilet bowl in order to flush the toilet. Such toilets are difficult to clean due to the overhanging rim that protrudes into the toilet bowl space. Rim toilets also have many orifices in order to rinse and flush the toilet. These orifices are easy targets for bacterial growth and frequently stain. Rimless toilet are currently available which boast easier cleaning and more effective flushing. However, even these rimless toilets have orifices in the toilet bowl which are prone to staining from iron or sediment deposits from water used in the toilet. A large rim also adds thickness to the toilet bowl, thus reducing the open area for capturing urine from standing urination and increasing the frequency with which urine is sprayed or splashed onto the toilet rim.

Rim rinsing requires large amounts of water to rinse excrement adhered to the bowl, and is often ineffective in that goal. Rim rinse water detracts from the amount of water per flush that can be used for the flushing jet, which creates many engineering design constraints for a toilet that lead modern low flush volume toilets to have narrower or longer trapways that are more easily clogged. The relative amounts of rinse water and jet water is typically not dynamically varied during a flush. Rim rinse water is often not separate from flush water. Thus, rim rinsing requires disinfecting or cleaning agents to either be used in all rinse and flush water. Otherwise, disinfecting or cleaning agents must be applied to the toilet manually by external means.

What is needed is a toilet with a minimized rim or without a rim at all in order to decrease bowl thickness and increase the area for capturing human waste. Furthermore, what is needed is a means of separating rinse water from flush water, so that disinfecting or cleaning agents may be used at a minimum, which is ecologically preferred, material saving, and more energy efficient. Ideally, such improvements in a toilet would increase toilet cleanliness, reduce cleaning frequency, and provide toilet users with a more comfortable experience.

SUMMARY

This invention has been developed in response to the present state of the art and, in particular, in response to the problems and needs in the art that have not yet been fully solved by currently available systems. Accordingly, an improved toilet seat has been developed. Features and advantages of different embodiments of the invention will become more fully apparent from the following description and appended claims, or may be learned by practice of the invention as set forth hereinafter.

Consistent with the foregoing, a rinsing seat for a rimless toilet is disclosed. An annular cavity and outlet nozzles are disclosed which allow the rinsing seat to dispense rinse water into a toilet bowl. In one embodiment the annular cavity is of sufficient size to store a full flushing volume of water. In another embodiment, the annular cavity is minimized in size so that rinse water is passed through, but not stored in significant quantities, in the rinsing seat. Seat supports having interior cavities for the passage of water tubes or pipes are disclosed. A motorized hinge assembly and various sensors are disclosed which may allow the rinsing seat to function autonomously in response to a toilet user's movement, position, or bio data. A pressurized line and disinfectants which may increase the rinsing seat's cleaning effectiveness are also disclosed and claimed herein.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
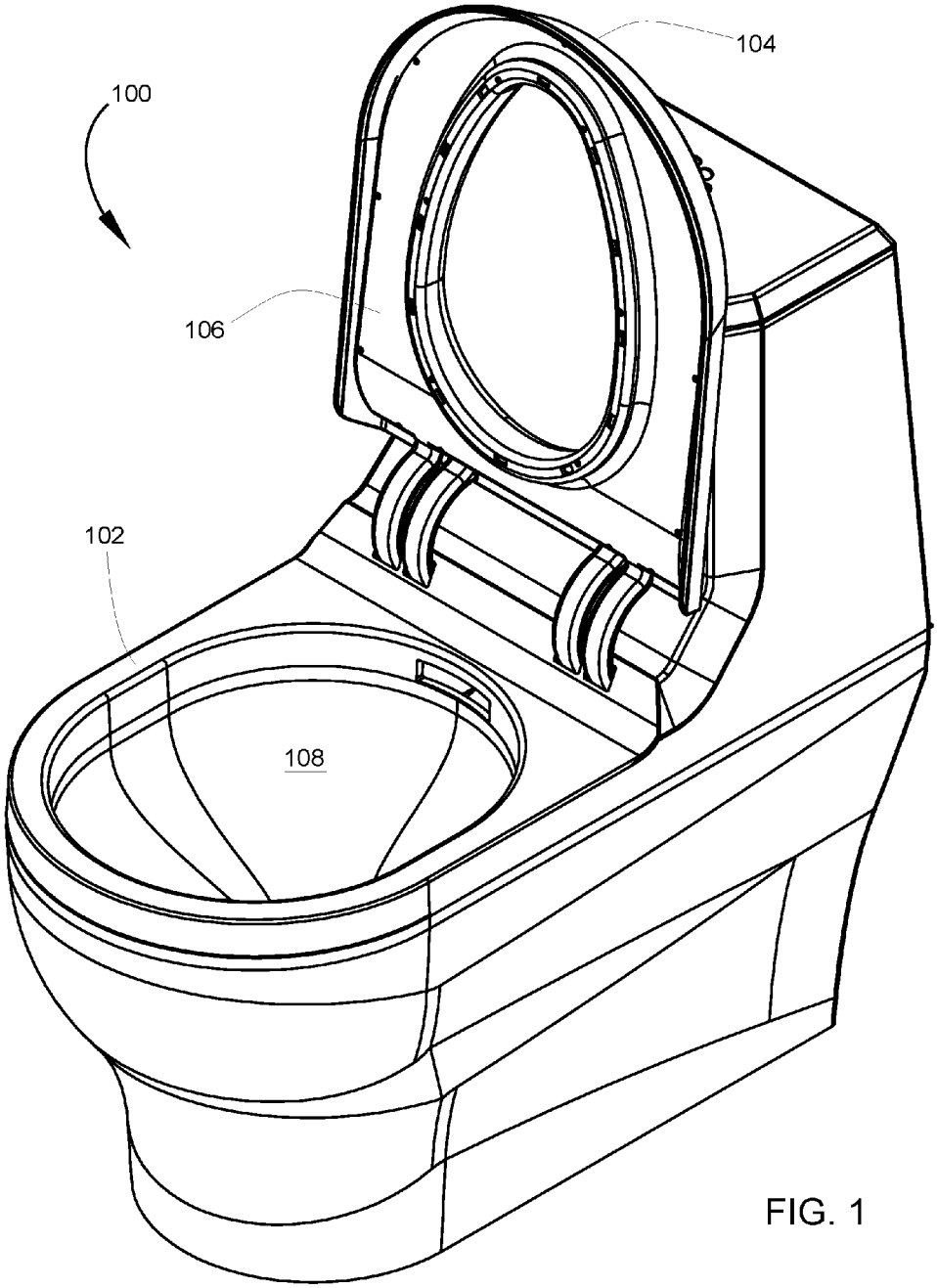
FIG. 1 shows a perspective view of a rimless toilet utilizing the present invention.

Referring to FIG. 1, a toilet 100. The toilet 100 comprises a rimless top 102, a lid 104, a rinsing seat 106, and a bowl 108. The rinsing seat 106 is capable of rinsing the bowl 108 in a manner described hereafter. The rinsing seat 106 performs the bowl rinsing function of a conventional rimmed toilet, and thus enables a rimless top 102 design. The rinsing seat 106 may be capable of rinsing the bowl 108 and flushing the toilet 100 entirely, or may be capable of flushing the toilet 100 in conjunction with a water jet elsewhere in the toilet that initiates a flush.

Figure 2:
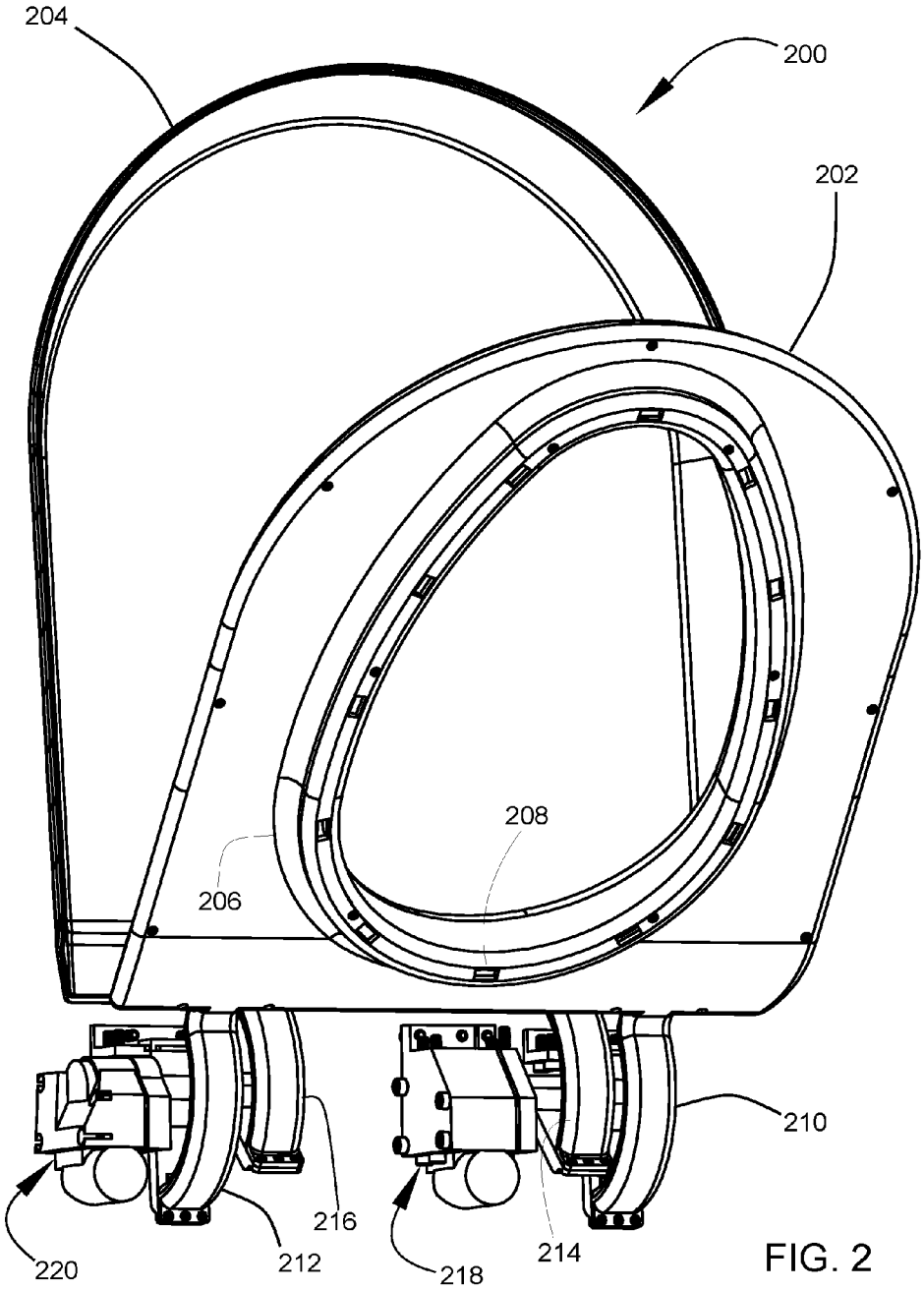
FIG. 2 shows a perspective view of a rinsing seat and toilet lid hingedly attached to hinge assemblies.

FIG. 2 shows a toilet seat assembly 200 utilizing a rinsing seat 202. The rinsing seat 202 comprises an annular ridge 206 which extends about the circumference of the opening in the rinsing seat 202. The annular ridge 206 further comprises outlet nozzle openings 208 arranged circumferentially about the opening in the rinsing seat 202. The outlet nozzle openings 208 are pointed generally away from the rinsing seat 202 so that when the seat is in a down or closed position, the outlet nozzle openings 208 point generally downward into a toilet bowl. The annular ridge 206 comprises a volume sufficient to provide the outlet nozzle openings 208 with sufficient water to perform a bowl rinse, whether the water be pressurized, passed through water tubes, passed through water pipes, or passed through a cavity in the rinsing seat 202 in a manner described hereafter. The rinsing seat 202 further comprises a first support 210 and a second support 212 at its base, the first support 210 being hingedly attached to a first hinge assembly 218, and the second support 212 being hingedly attached to a second hinge assembly 220. The toilet seat assembly 200 also comprises a lid 204 which comprises a first lid support 214 and a second lid support 216, the first lid support 214 being attached to the first hinge assembly 218 and the second lid support 216 being attached to the second hinge assembly 220. The toilet seat assembly supports 210, 212, 214, 216 are each arcuate in shape. The first support 210 and the second support 212 each comprise a hollow interior cavity through which water tubes or electrical wires may be passed into the rinsing seat 202. The first hinge assembly 218 and the second hinge assembly 220 may comprise motors so that the movement of the rinsing seat 202 and the lid 204 is motorized. The motorized rinsing seat 202 and lid 204 would be particularly helpful to toilet users with a medical condition that prevents them from easily reaching, moving, or lifting objects. The use of motors also gives the toilet seat assembly 200 a capacity for autonomous function. For example, the motors may be controlled by a controller, which comprises a processor and a memory unit. The processor may also be connected to seat sensors such as strain gauges or pressure transducers in the rinsing seat 202. The processor may also be connected to proximity sensors in the rinsing seat 202 or in the lid 204. The processor may also be connected seat sensors that measure displacement of water in the toilet bowl. Using these sensors, the processor may determine that a user is sitting on the rinsing seat 202, or otherwise using the toilet by monitoring connected sensors. When a user is detected to have finished using the toilet and is also detected to no longer be sitting on the toilet, the processor may use the controller to automatically close the toilet lid 204 and perform a toilet flush. The processor may also monitor sensors to determine when a user intends to urinate into the toilet from a standing position and automatically lift the rinsing seat 202 using motors in the first hinge assembly 218 and the second hinge assembly 220.

Figures 3A, 3B:
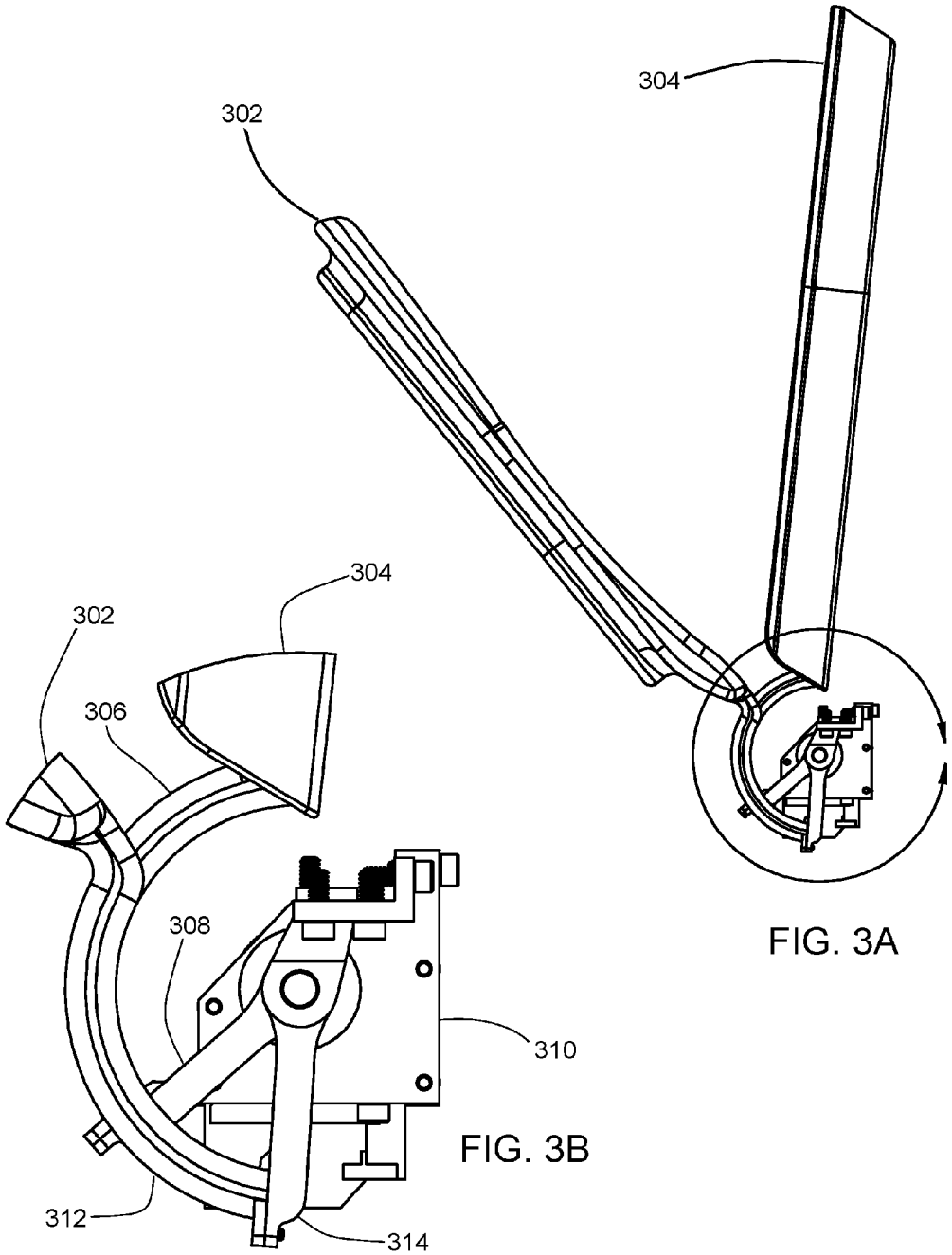
FIGS. 3A and 3B show a side view and close-up side view respectively of a rinsing seat and toilet lid hingedly attached to a hinge assembly by means of arcuate supports.

FIG. 3A shows a side view of a toilet seat assembly comprising a rinsing seat 302 in a partially open position and a lid 304 in an upright or open position. FIG. 3B shows a close up view of the same side view shown in FIG. 3A. The rinsing seat 302 is shown having an arcuate support 312, which is attached to a first hinge member 314. The lid 304 is shown having a lid arcuate support 306, which is attached to a second hinge member 308. The first hinge member 314 and the second hinge member 308 are pivotally attached to a hinge assembly 310. The hinge assembly may be rigidly attached to a toilet body so that the rinsing seat 302 and the lid 304 are attached to the toilet. The hinge assembly may comprise a motor so that the rinsing seat 302 and the lid 304 can be controlled automatically by a processor in a manner described previously. The first hinge member 314 and the second hinge member 308 provide attachment points to the arcuate support 312 and the lid arcuate support 306 respectively and allow movement of the rinsing seat 302 and lid 304 to occur at an offset distance away from the axis of rotation of the hinge assembly 310.

Figure 4:
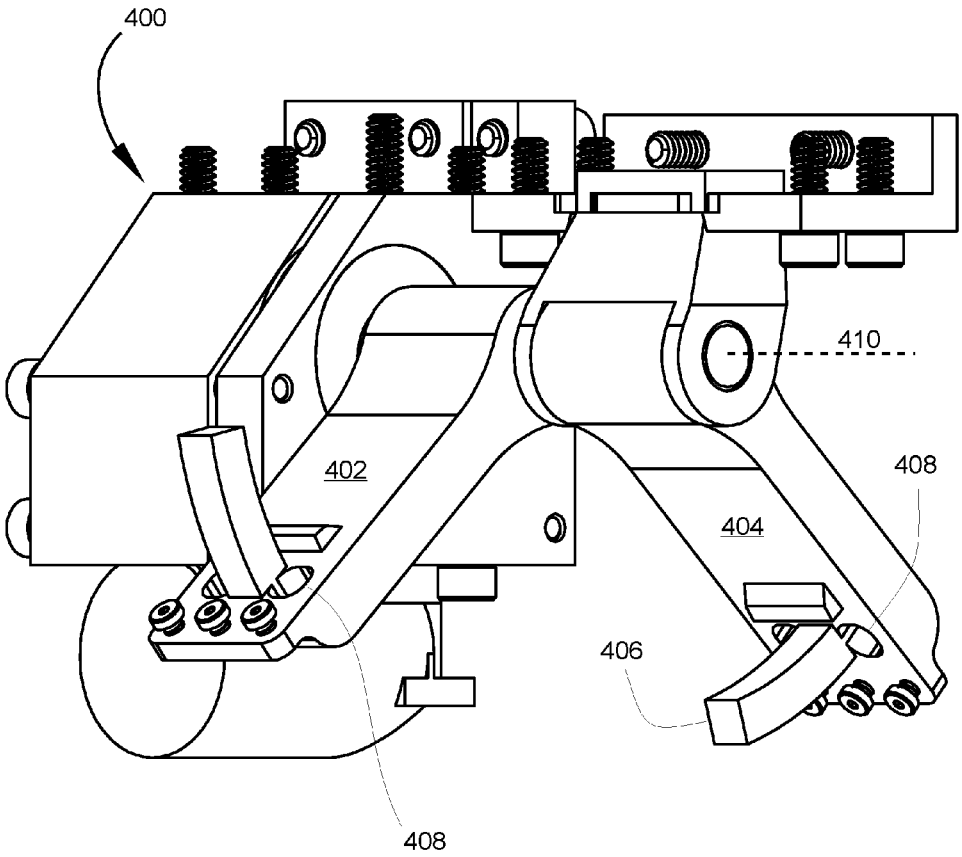
FIG. 4 shows a hinge assembly with hinge members pivotally attached to an axis of rotation of the hinge assembly.

FIG. 4 shows a hinge assembly 400 having a first hinge member 402 and a second hinge member 404 pivotally attached to an axis of rotation 410 of the hinge assembly. The first hinge member 402 and the second hinge member 404 comprise a protrusion 406 which is designed to fit into a cavity of a seat or lid support. The protrusion 406 provides a guide for fitting a support onto a hinge member 402, 404 and also provides structural rigidity when a seat or lid support is attached onto a hinge member 402, 404. The hinge members 402, 404 also comprise openings 408 which may allow tubes or electrical wires to be passed through the hinge members 402, 404 and into a cavity in a toilet seat or lid. Electrical wires passed through the openings 408 may be connected to bio sensors attached to the toilet seat. The electrical wires may also be connected to other sensors used to detect the presence of a toilet user, such as proximity sensors, strain gauges, infrared sensors, or range finding sensors. Detection and bio sensors may be used such that a processing unit is capable of detecting when a user is sitting on the toilet and may automatically lower the toilet lid and flush the toilet upon a user removing his/herself from the toilet seat. The sensors may also be used such that a processing unit is capable of detecting when a user is approaching a toilet and the processor may raise the toilet lid in response as a means of preparing the toilet for use by the user. The sensors may also be used to detect when a male user is preparing to urinate into the toilet while standing, and the processor may lift both the toilet lid and toilet seat in preparation. The seat sensors and bio sensors may be connected to a processor and a memory unit such that the processor can receive, save, and recall bio sensor data in order to identify a user whose bio data is saved in the memory unit.

Figure 5:
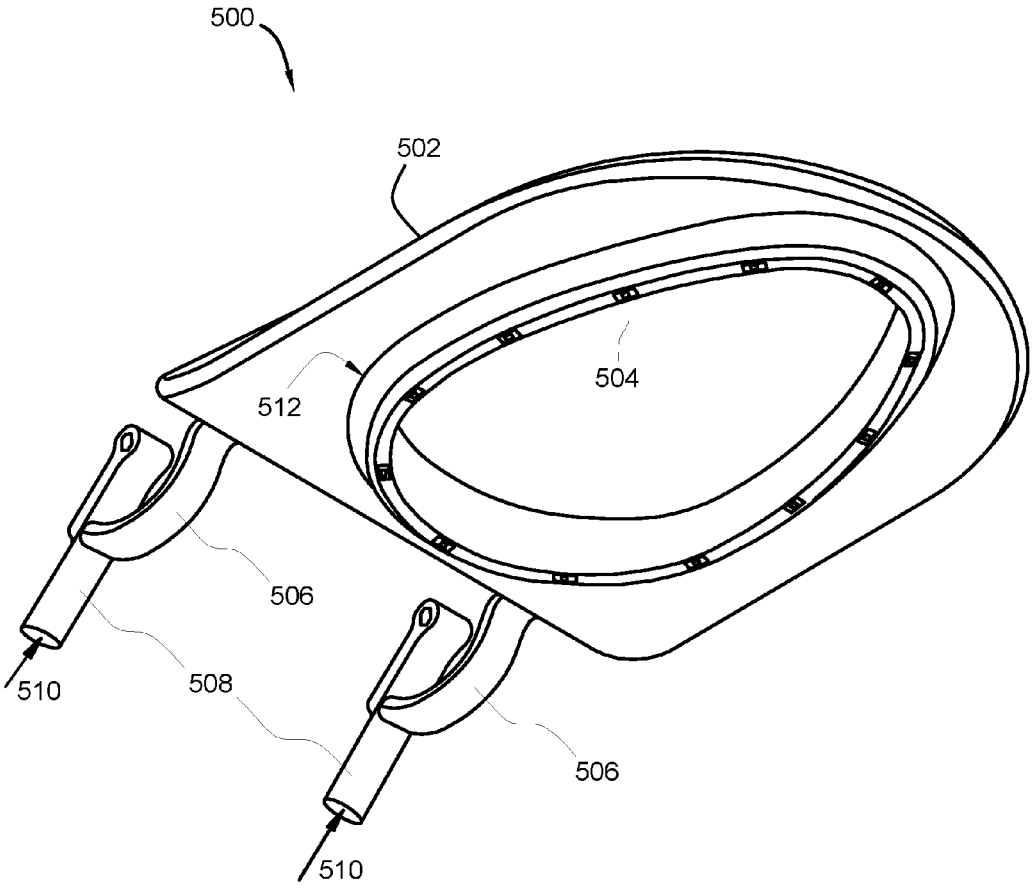
FIG. 5 shows a perspective view of a rinsing seat having inlet tubes connected to seat supports.

FIG. 5 shows a rinsing seat assembly 500 with a rinsing seat 502 having an annular ridge 512 about the circumference of the seat opening. The annular ridge 512 comprises outlet nozzles 504 arranged circumferentially about the seat opening. The rinsing seat 502 is also shown comprising arcuate supports 506 having inlet tubes 508. The inlet tubes 508 allow fluid flow 510 into the rinsing seat 502 and out of the outlet nozzles 504.

Figure 6:
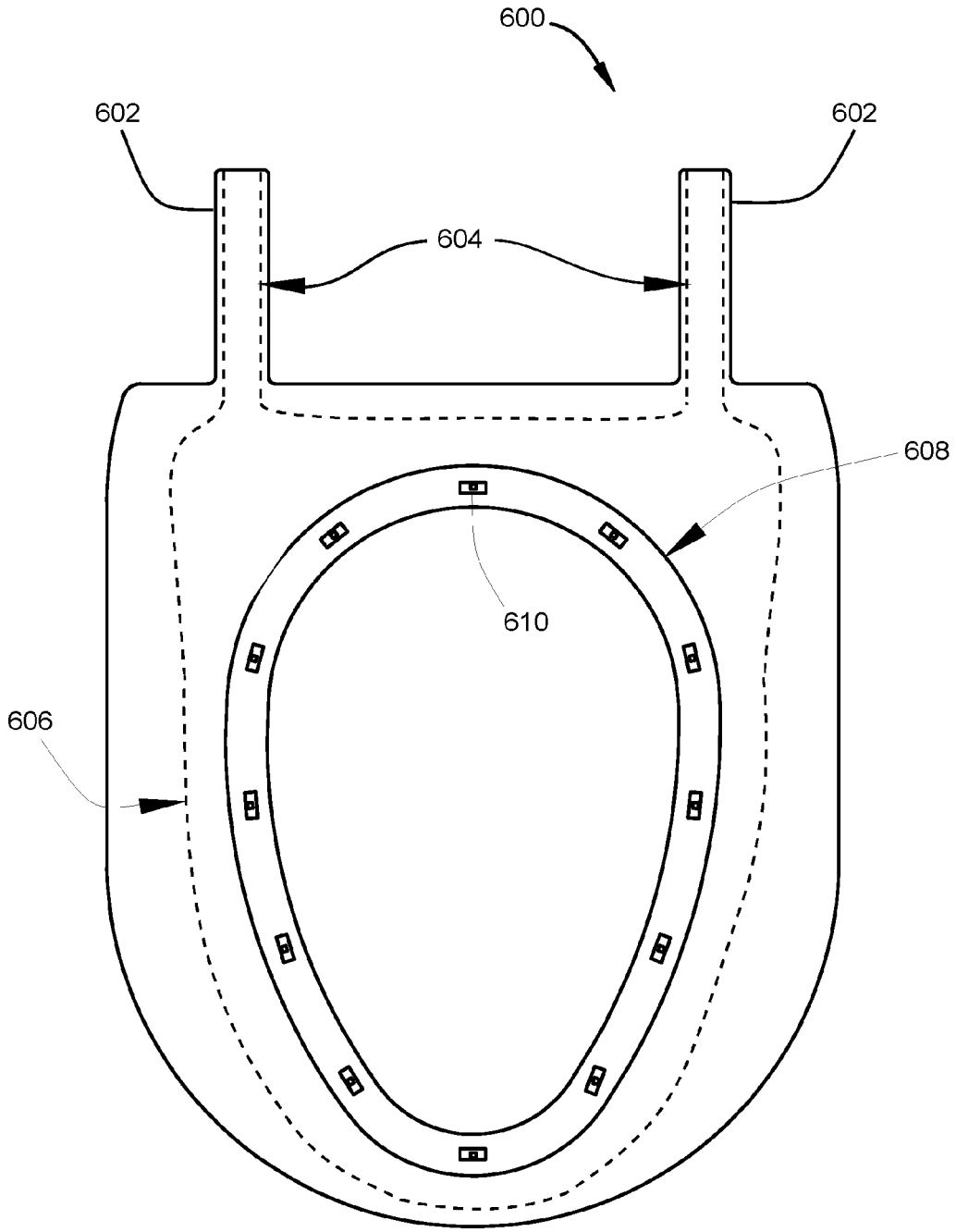
FIG. 6 shows a bottom view of a rinsing seat having a large annular cavity.

FIG. 6 shows a bottom view of one embodiment of a rinsing seat 600. The rinsing seat 600 is shown comprising supports 602 with inlet ports 604. The inlet ports 604 are shown being connected to an annular cavity 606 inside of the rinsing seat 600. The inlet ports 604 allow water to be passed into the annular cavity 606 and out of outlet nozzles 610 arranged circumferentially about the rinsing seat 600. The edges of an annular ridge 608 are also shown, the ridge providing a space for the circumferentially arranged outlet nozzles 610 and directing the outlet nozzles 610 away from the rinsing seat 600. The annular cavity 606 may comprise a small volume of just 0.1 gallons inside of the rinsing seat 600 or it may comprise a range of volumes up to 1.6 gallons (the federal plumbing standard limit on the volume of water used per flush) inside of the rinsing seat 600. Thus the rinsing volume of water dispensed by the rinsing seat may comprise anywhere between 0.1 to 1.6 gallons. The annular cavity 606 will take on a generally annular shape due to the fact that the annular cavity surrounds the large opening in a rinsing seat 600. However, in order to fill a larger volume or compensate for the location of supports 602, the annular cavity may bulge at certain areas such as near the base of the seat where supports 602 meet the seat. The annular cavity 606 may be used for the purpose of storing and dispensing a rinsing volume of water to rinse a toilet bowl and partially flush the toilet, or it may be used for the purpose of dispensing a full volume of water capable of flushing the toilet. As an example, the annular cavity 606 may only comprise a volume in the rinsing seat 600 of about 0.1 gallons. In this case, the annular cavity would store only a small amount of water intended to rinse the toilet bowl and assist a water jet contained elsewhere in the toilet bowl below the nominal water level that provides the primary force and volume of water required to initiate and carry out a toilet flush. The annular cavity 606 is especially useful as a small volume if a pressurized line is passed through it and pressurized water is dispensed towards the toilet bowl through the outlet nozzles 610. The use of a pressurized line enables the toilet bowl to be rinsed efficiently with small volumes of water and allows more water to be used in a toilet jet during a flush, which decreases the likelihood of toilet clogs. Alternatively, a pressurized line may enable the total volume of water required to perform a toilet flush to be significantly reduced. A smaller annular cavity 606 is also particularly useful in the case that rinse water is separated from flush water. Although filtering entire quantities of flush water is impractical, filtering a separate and smaller rinse volume using in-line filters is practical and would eliminate or reduce the occurrence of stains in the toilet bowl caused by sediment deposits or build-up. Furthermore, separated rinse water may be treated with cleansers, deodorizers, or disinfectants which can be used to rinse, clean, deodorize, or disinfectant the toilet bowl either during a toilet flush or outside of a toilet flush. This provides a more ecologically preferred alternative method of cleaning, deodorizing, or disinfecting a toilet than treating an entire flush volume of water and also may improve the efficacy of cleaning or disinfecting agents when dispensed from a pressurized line. The annular cavity 606 may have a larger volume of up to 1.6 gallons so that it can store and dispense all of the water required to flush the toilet. The rinsing volume would then comprise a volume of water sufficient to fully flush the toilet without the assistance of a separate water jet elsewhere in the toilet. The water may be dispensed from the outlet nozzles under pressure, or the outlet nozzles may simply comprise larger openings through which the entire flush volume of water may be dispensed by force of gravity. The primary advantage of storing and dispensing large volumes of water through the toilet seat as opposed to through a toilet rim is that it allows for a completely rimless toilet design. A rimless toilet design increases the ease with which the toilet can be cleaned, eliminates stains caused by bacterial build-ups or sediment deposits at orifices, and increases the open area of the reservoir used to collect waste (which also increases toilet cleanliness by reducing the amount of urine or waste that may be sprayed or splashed onto the toilet rim by inaccurate urination and/or defecation).

Figure 7:
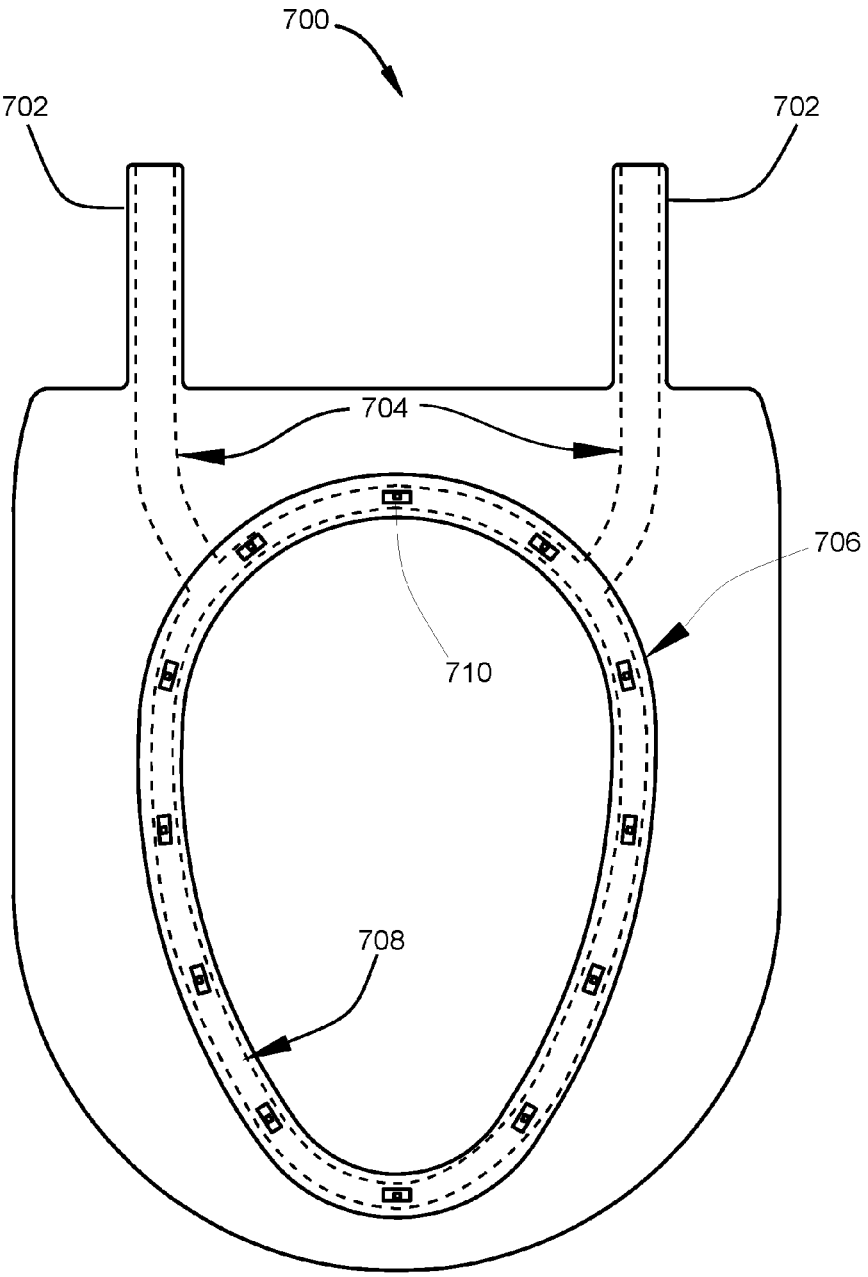
FIG. 7 shows a bottom view of a rinsing seat having a smaller annular cavity for integration of a pressurized line.

FIG. 7 shows a bottom view of an embodiment of a rinsing seat 700. The rinsing seat 700 is shown comprising an annular ridge 706 about the circumference of the rinsing seat opening through which a user would deposit waste. An annular cavity 708 is shown extending about the circumference of the rinsing seat in a similar manner to the annular ridge 706. The annular cavity 708 is also shown being connected to inlet ports 704 which pass through supports 702 and may connect a remote water source to the annular cavity 708. The rinsing seat 700 is also shown comprising outlet nozzles 710 arranged circumferentially about the rinsing seat opening and approximately evenly spaced throughout the circumference of the annular ridge. This particular embodiment of the rinsing seat 700 minimizes the volume of the annular cavity so that water does not need to be stored in the rinsing seat 700 before being dispensed into the toilet to perform a rinsing or flushing function. The remote water source may comprise a tank such as is commonly found on conventional toilets, and water may be passed through the inlet ports 704 and the annular cavity 708 so as to be dispensed by the force of gravity through the outlet nozzles 710. The remote water source may comprise a pressurized utility line provided by a building, which could then provide pressurized water through the inlet ports 704 and the annular cavity 708 so the pressurized water may be dispensed through the outlet nozzles 710. The remote water source may alternatively comprise a water tank or vessel which is pressurized by use of a water pump, compressor, or turbine so as to achieve water pressures greater than conventional building utility line pressures (which are usually within 35-80 psi). Use of a pressurized line to provide pressurized water dispersion through the outlet nozzles 710 allows toilet bowl rinsing and/or cleaning to be achieved using smaller volumes of water, and thus serve to conserve the amount of water required to keep a toilet hygienic and operational. In addition, the use of a separate pressurized line allows the use of one or more filters to filter water passed through annular cavity 708 and outlet nozzles 710, thus reducing or eliminating toilet staining caused by sediment deposits or build-up. The pressurized water may be additionally treated or combined with a disinfectant or deodorant. The disinfectant may be an oxidizer, ozone, a bleaching chemical, or a combination thereof. The inlet ports 702 may comprise flexible water tubes or pipes connected to an annular tube or pipe fitted within the annular cavity 708. Alternatively, the annular cavity 708 may be capable of housing and passing pressurized water within itself and without the use of a separate tube or pipe. The outlet nozzles 710 may comprise openings which are always open so that water is always dispensed when passed through the inlet ports 704 and annular cavity 708. The outlet nozzles 710 may comprise sprayers which can increase the pressure at which water is dispensed and direct the water in a particular direction. The outlet nozzles 710 may comprise actuators which open and close in response to electrical controls so that pressurized water may always be stored within the annular cavity and dispensed immediately. A bidet may also be included in the rinsing seat 700, which provides pressurized water in a generally opposite direction to the outlet nozzles 710 for the purpose of cleaning a user's body. The bidet may also provide pressurized water in a direction towards the toilet bowl to clean portions of the toilet bowl.

Figure 8:
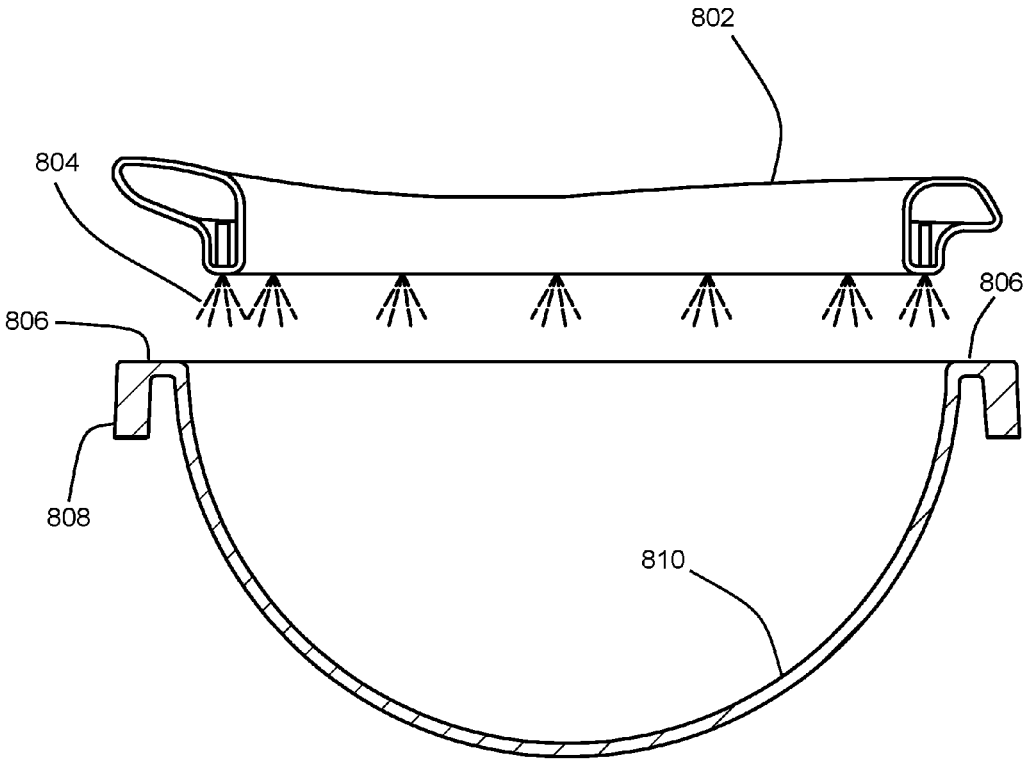
FIG. 8 shows a cross sectional view of a rinsing seat dispensing rinse water into a rimless toilet bowl.

FIG. 8 shows a rinsing seat 802 positioned above a toilet bowl 810. The toilet bowl 810 comprises a rimless top 806 and outer wall 808. The rinsing seat 802 is shown having an annular ridge which fits within the circumference of the toilet bowl 810 and a seat portion which can rest against the rimless top 806 when the seat is in a lowered position or when a user is sitting on the rinsing seat 802. The rinsing seat is shown dispensing rinse water 804 downward into the toilet bowl 810 for the purpose of cleaning the interior surfaces of the toilet bowl 810. The rimless top design of a toilet bowl increases the open area into which urine from standing urination may pass through to enter the toilet bowl, thereby decreasing the likelihood of urine spreading about unrinsed surfaces of the toilet and increasing overall toilet cleanliness. In addition, bacterial growths or stains are reduced by using outlet nozzles in the rinsing seat 802 instead of orifices in a rim of the toilet bowl 810. Stains and growths may easily be cleaned by passing disinfecting agents through the rinse water 804, and tough stains and growths are generally hidden from view when the toilet seat is down, as opposed to always being visible within a rimmed toilet.

Figure 9A:
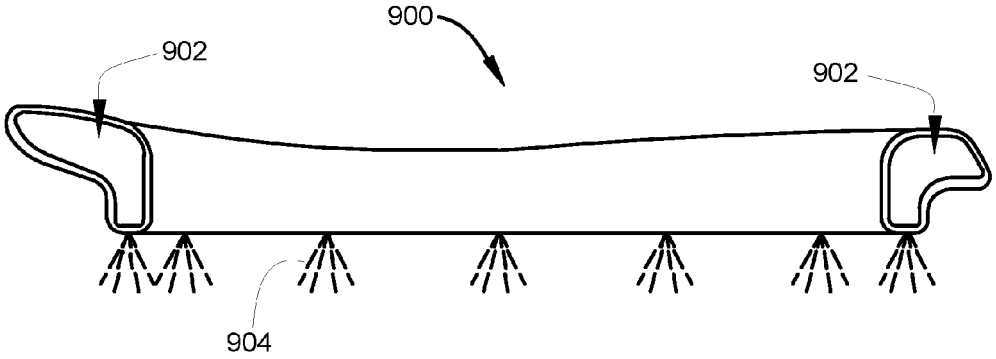
FIGS. 9A and 9B show two embodiments of annular cavities within rinsing seats.
Figure 9B:
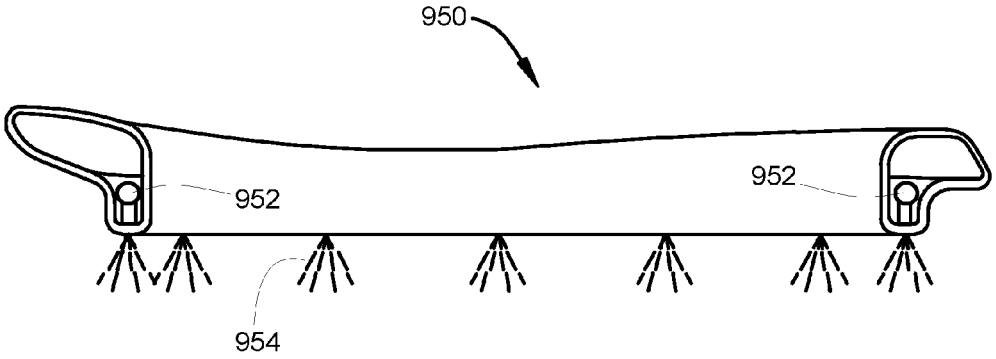

FIGS. 9A and 9B show two embodiments of rinsing seats 900, 950. FIG. 9A shows a rinsing seat 900 having a large annular cavity 902 which comprises much of the volume of the rinsing seat 900 interior. The large annular cavity 902 maximizes the volume of water that may be stored in the rinsing seat 900 and dispensed as rinse water 904. The large annular cavity 902 may comprise supports within itself to provide additional structural rigidity to the rinsing seat 900 so that a heavy user does not break the rinsing seat 900 and cause rinse water to be dispensed through cracks or openings besides outlet nozzles. An additional advantage of a large annular cavity 902 is that the surface temperature of the rinsing seat 900 may be increased or decreased by increasing or decreasing the temperature of water stored within the large annular cavity 902. For example, because a cold toilet seat may cause a user discomfort during the night-time or during a cold weather season, a user or preprogrammed system may increase the surface temperature a user is exposed to when sitting on the seat by heating the water stored or passed through the large annular cavity 902. FIG. 9B shows a rinsing seat 950 comprising a pressurized water line 952 within an annular cavity smaller than the one shown in FIG. 9A dispensing rinse water 954. The pressurized line may comprise a flexible tube or a rigid pipe. The advantages of a pressurized line are heretofore described. The primary advantage of an annular cavity or reduced volume is increased structural rigidity in the rinsing seat 950, which gives the rinsing seat 950 a greater resiliency to high loads and stresses imposed by a user.

Figure 10A:
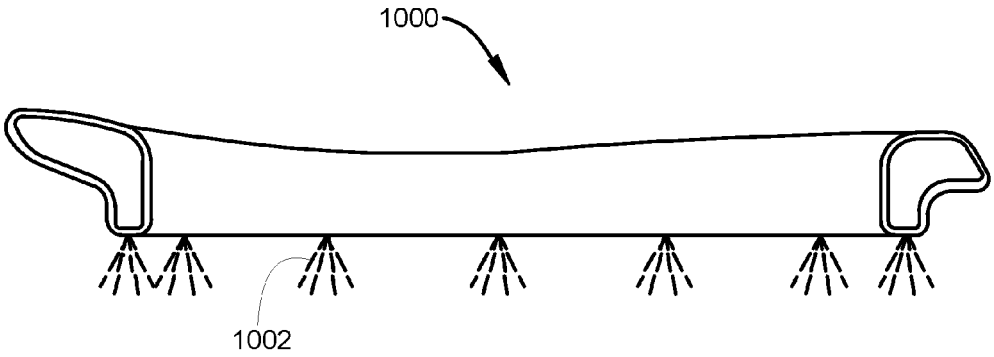
FIGS. 10A and 10B show two embodiments of rinsing seats each dispensing rinse water at different angles relative to the rinsing seat.
Figure 10B:
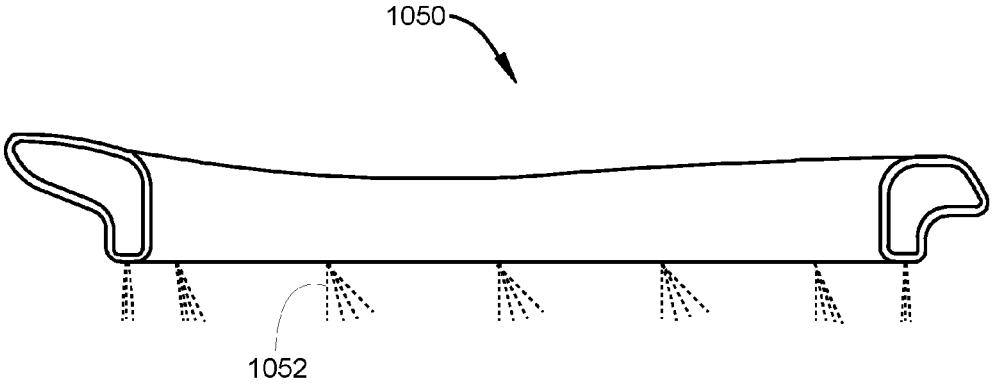

FIGS. 10A and 10B show rinsing seats 1000, 1050 each having outlet nozzles that direct rinse water in different directions relative to the rinsing seats 1000, 1050. FIG. 10A shows a rinsing seat 1000 dispensing rinse water 1002 generally away from the rinsing seat 1000 in an angle perpendicular to the surface of the rinsing seat 1000. FIG. 10B shows a rinsing seat 1050 dispensing rinse water 1052 generally away from the rinsing seat 1050 and at an angle to the surface of the rinsing seat 1052. Dispensing the rinse water 1052 at an angle may facilitate the motion of water in a toilet flush by assisting the formation of a whirlpool in the toilet bowl, which is commonly understood in the art to provide optimal flushing velocity and force. The rinsing seat 1050 may comprise oscillating sprayers so that rinse water 1052 is dispensed at variable angles relative to the surface of the rinsing seat 1050. Oscillating sprayers allow a greater surface area of the toilet bowl to be rinsed by the rinse water 1052 using fewer outlet nozzles. Oscillating sprayers also decrease the likelihood of a portion of the toilet bowl being left unclean because rinse water 1052 dispensed from the outlet nozzle was not directed to all portions of the bowl surface.

Figure 11A:
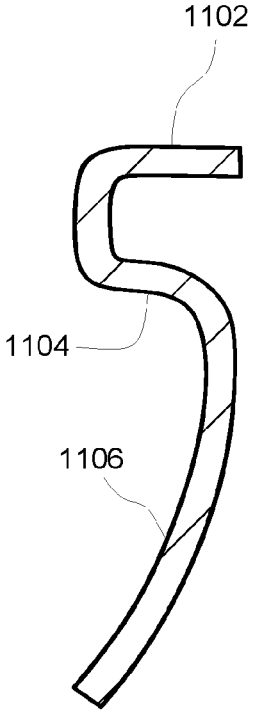
FIGS. 11A and 11B show cross-sectional views of a rimmed toilet and rimless toilet design respectively.
Figure 11B:
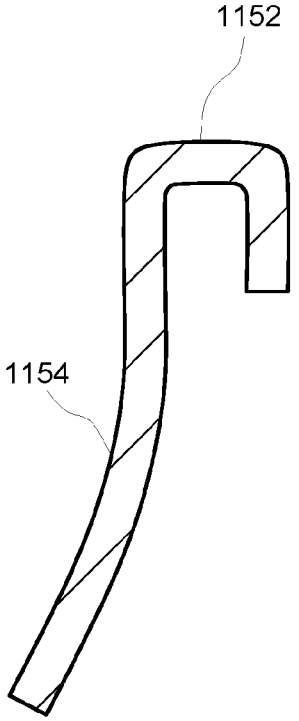

FIGS. 11A and 11B show cross-sectional views of a rimmed toilet and rimless toilet so that the advantages of a rimless toilet design may be made more apparent. FIG. 11A shows a rimmed toilet design wherein a rimmed toilet top 1102 and rim ledge 1104 are connected to a rimmed bowl wall 1106. The rimmed design requires that the rimmed toilet top 1102 extend inwards and hang over the rimmed bowl wall 1106 so that the open area through which a toilet user may deposit waste is decreased. The rim ledge 1104 also causes the formation of a corner between the rim ledge 1104 and rimmed bowl wall 1106, which is more difficult for a user cleaning the toilet to reach. FIG. 11B shows a rimless toilet design wherein a rimless top 1152 is shown connected to a rimless bowl wall 1154. The rimless top does not hang over the rimless bowl wall 1154 and thus provides a larger open area through which a toilet user may deposit waste and a continuous surface between the rimless top 1152 and rimless bowl wall 1154 which is easier for a user to clean.

The apparatuses disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A toilet seat comprising:

an annular cavity, said annular cavity comprising inlet ports connected to a remote water source, wherein the annular cavity is disposed inside the toilet seat;

an annular ridge, wherein the annular ridge extends circumferentially about an opening, wherein the opening is encircled by the toilet seat;

a plurality of outlet nozzles, wherein the plurality of outlet nozzles is disposed within the annular ridge and directed to a toilet bowl of a toilet, the plurality of outlet nozzles being connected to the annular cavity; and wherein a rinsing volume of water is dispensed out of the toilet seat through the plurality of outlet nozzles.

2. The toilet seat of claim 1, wherein the rinsing volume comprises a volume of water sufficient to fully flush the toilet.

3. The toilet seat of claim 1, wherein the annular cavity further comprises a volume sufficient to store water and flush the toilet using only the stored water expelled through the outlet nozzles.

4. The toilet seat of claim 1, wherein the remote water source is pressurized, the annular cavity further comprises a pressurized line, and the pressurized line is capable of dispensing pressurized water out of the outlet nozzles.

5. The toilet seat of claim 4, wherein the remote water source is a pressurized utility line of a building.

6. The toilet seat of claim 1 further comprising one or more supports, each of said one or more supports being hingedly attached to a hinge assembly.

7. The toilet seat of claim 6, wherein the one or more supports are arcuate in shape.

8. The toilet seat of claim 7, wherein the one or more supports each comprise an interior cavity connected to the inlet ports, each inlet cavity being connected to the remote water source.

9. The toilet seat of claim 8, wherein each interior cavity further comprises a water tube, each water tube being capable of passing water from the remote water source into the inlet ports.

10. The toilet seat of claim 6, wherein the hinge assemblies comprise one or more motors capable of rotating the toilet seat, the one or more motors being actuated by a controller, the controller being in communication with a processor and a memory unit.

11. The toilet seat of claim 10 further comprising one or more seat sensors, said one or more seat sensors being in communication with the processor.

12. The toilet seat of claim 11, wherein the processor is capable of detecting when a user is using the toilet by means of the one or more seat sensors, the processor also being capable of lifting and lowering the seat by means of the controller based on inputs from the one or more seat sensors.

13. The toilet seat of claim 1, wherein the outlet nozzles direct water away from the toilet seat and perpendicular to the toilet seat.

14. The toilet seat of claim 1, wherein the outlet nozzles direct water away from the toilet seat at an angle to the toilet seat.

15. The toilet seat of claim 1, wherein the outlet nozzles comprise oscillating sprayers.

16. The toilet seat of claim 1, wherein the remote water source is combined with a disinfectant, the disinfectant being dispensed with water through the outlet nozzles and the disinfectant comprising one or more of an oxidizer, ozone, bleaching chemical, or a combination thereof.

17. The toilet seat of claim 1 further comprising a bidet.

18. The toilet seat of claim 1 further comprising bio sensors, a processor, and a memory unit, the processor capable of identifying a user based on data received from the bio sensors and saved data in the memory unit.

19. The toilet seat of claim 1 further comprising one or more filters, and wherein water from the remote water source passes through the one or more filters before being dispensed from the outlet nozzles.

* * * * *